US006244326B1

(12) United States Patent
Grieco

(10) Patent No.: US 6,244,326 B1
(45) Date of Patent: Jun. 12, 2001

(54) CUSTOMIZABLE DEVICE FOR TYING BACK A GROUP CONSISTING OF CURTAINS, DRAPERIES, DECORATIONS, TOWELS AND VERTICAL BLINDS

(76) Inventor: Angelina Grieco, 28 Contessa Ct., Port Jefferson, NY (US) 11777

( * ) Notice: Subject to any disclaimer, the term of this patent is extended or adjusted under 35 U.S.C. 154(b) by 0 days.

(21) Appl. No.: 09/662,624

(22) Filed: Sep. 15, 2000

(51) Int. Cl.[7] ..... A47H 19/00
(52) U.S. Cl. ..... 160/349.2
(58) Field of Search ..... 160/394.2, 349.1, 160/330, 348, 123, 124, 126, 178.1 R, 178.1 V

(56) References Cited

U.S. PATENT DOCUMENTS

| | | | | |
|---|---|---|---|---|
| 1,882,527 | * | 10/1932 | Stanley | 160/349.1 |
| 1,917,828 | * | 7/1933 | Coen | 160/349.1 |
| 2,247,253 | * | 6/1941 | Rosenberg | 160/349.1 |
| 2,391,205 | * | 12/1945 | Van Cleeff | 160/349.2 |
| 2,563,306 | * | 8/1951 | Burrage | 160/349.2 |
| 2,622,675 | * | 12/1952 | Jitomir | 160/349.2 |
| 3,754,589 | * | 8/1973 | Heimberg et al. | 160/349.2 |
| 4,278,714 | * | 7/1981 | Schwartz | 160/349.2 |
| 4,333,187 | * | 6/1982 | Schuler | 160/330 X |
| 5,240,059 | | 8/1993 | White | 160/349.2 |
| 5,692,553 | | 12/1997 | Jensen | 160/178.1 V |
| 5,901,413 | | 5/1999 | Patee | 16/87 R |
| 5,937,927 | | 8/1999 | Keith | 160/89 |
| 5,947,177 | | 9/1999 | Kratzer | 160/178.1 V |

* cited by examiner

*Primary Examiner*—David M. Purol
(74) *Attorney, Agent, or Firm*—Richard L. Miller, P.L.

(57) ABSTRACT

A customizable device for tying back an item selected from the group consisting of curtains, draperies, decorations, towels, and vertical blinds to a wall. The device includes a strap that is slender, elongated, and has a curtain-facing surface, an ambient-facing surface that is opposite to the curtain-facing surface thereof, and a pair of ends. One end of the strap is attached to the wall. The strap is tubular and opens at the pair of ends thereof so as to allow insertion of a material therein so as to customize the strap. The pair of ends of the strap are relieved on the curtain-facing surface thereof so as to facilitate insertion of the material. The strap is clear so as to allow the material therein to be visible therethrough.

2 Claims, 1 Drawing Sheet

CUSTOMIZABLE DEVICE FOR TYING BACK A GROUP CONSISTING OF CURTAINS, DRAPERIES, DECORATIONS, TOWELS AND VERTICAL BLINDS

BACKGROUND OF THE INVENTION

1. Field of the Invention

The present invention relates to a device for tying back a group consisting of curtains, draperies, decorations, towels and vertical blinds to a wall. More particularly, the present invention relates to a customizable device for tying back a group consisting of curtains, draperies, decorations, towels and vertical blinds to a wall.

2. Description of the Prior Art

Numerous innovations for tie backs for window coverings have been provided in the prior art that will be described. Even though these innovations may be suitable for the specific individual purposes to which they address, however, they differ from the present invention.

A FIRST EXAMPLE, U.S. Pat. No. 5,240,059 to White teaches a tie member for wrapping around a gathered section of a curtain suspended from a curtain rod that includes a loop for placing around the curtain rod and either one or two flexible leg portions extending from the loop. The tie member optionally includes patches of hook-and-loop fastener material on the flexible leg portions positioned to mesh together when the flexible leg portions are wrapped around the gathered sections. A method for wrapping a single flexible leg portion of a single tie member around a gathered section, the section having an outer edge, includes the steps of wrapping the flexible leg portion over the front of the gathered section away from the outer edge, wrapping the flexible leg portion around the back of the gathered section and fastening the flexible leg portion to itself. A method for wrapping the flexible leg portions of two single leg tie members around a gathered section, includes the steps of wrapping each flexible leg portion across the back of the gathered section, wrapping each flexible leg portion around the front of the gathered section and fastening the flexible leg portions together. A method for wrapping the flexible leg portions of a single two leg tie member around the gathered section is also provided.

A SECOND EXAMPLE, U.S. Pat. No. 5,692,553 to Jensen teaches a vertical blind retaining device including a bracket. The bracket has a back member with a pair of wings projecting outwardly and extending from opposite ends of the back member. Each wing is extended at a ninety degree angle from the back member. Each wing has a slot and a plurality of mounting holes. The mounting holes are used when mounting the bracket to a wall of a window frame. Lastly, a retaining plate is seated within the slots of the bracket. The retaining plate has a bottom end with a notch cut into each corner. The notch is for coupling with a closed end of the corresponding slot of the bracket. The retaining plat is capable of securing a vertical blind compressed within the bracket when the bracket is attached to the window frame.

A THIRD EXAMPLE, U.S. Pat. No. 5,901,413 to Patee teaches a vertical blind holder apparatus for collecting, gathering, and moving individual vertical blind panel segments away from an opening created by a sliding glass door. The apparatus comprises an extension unit which extends rearwardly from, and is operatively connected to the handle grip portion of the handle member of the sliding glass door to collect the individual vertical blind panel segments as the sliding glass door is opened.

A FOURTH EXAMPLE, U.S. Pat. No. 5,937,927 to Keith teaches a drapery fabric for enhancing vertical blinds. The drapery fabric is pre-formed with reception pockets for installation over the upper ends of vertical blinds. The pockets may have gaps for easy installation over preexisting vertical blinds. In one method of installation, the vertical blinds are removed from their traverse rod track, instead into the pockets with the swivel mounts passing through the gaps, and then installed upon the track. This results in the effect of "full" draperies, with the ability to optionally partially install over the length of the vertical blinds, either vertically or horizontally, and seal the gaps at the edges of standard vertical blinds.

A FIFTH EXAMPLE, U.S. Pat. No. 5,947,177 to Kratzer teaches a sun tie for attachment to a conventional vertical blind, when the blind is drawn to the closed position with the slats rotated to the position in which they are parallel to the plane of the window, to block entry of some heat and light, while permitting a view through the window. The sun tie has an anchor clip or pocket within which a left or right most one of a group of slats of the vertical blind is securely retained. A group clip of the sun tie removably retains the remaining ones of the group of slats. Each of the sun ties preferably retains 4–7 slats, so that several sun ties may be required to be installed on a particular vertical blind, depending on its width.

It is apparent that numerous innovations for tie backs for window coverings have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a customizable device for tying back a group consisting of curtains, draperies, decorations, towels and vertical blinds to a wall that avoids the disadvantages of the prior art.

ANOTHER OBJECT of the present invention is to provide a customizable device for tying back a group consisting of curtains, draperies, decorations, towels and vertical blinds to a wall that is simple and inexpensive to manufacture.

STILL ANOTHER OBJECT of the present invention is to provide a customizable device for tying back a group consisting of curtains, draperies, decorations, towels and vertical blinds to a wall that is simple to use.

BRIEFLY STATED, YET ANOTHER OBJECT of the present invention is to provide a customizable device for tying back a group consisting of curtains, draperies, decorations, towels and vertical blinds to a wall that includes a strap that is thin, slender, elongated, and has a curtain-facing surface, an ambient-facing surface opposite to the curtain-facing surface thereof, and a pair of ends. The strap is tubular and opens at the pair of ends thereof for insertion of a material therein for customizing the strap. The pair of ends of the strap are relieved on the curtain-facing surface thereof for facilitating insertion of the material therein. The strap is clear for allowing the material therein to be visible therethrough and is made of flexible plastic for encircling the group consisting of curtains, draperies, decorations, towels and vertical blinds. The strap further has a first portion of hook and loop fasteners that is disposed at one end thereof, on the curtain-facing surface thereof, and a second portion of hook and loop fasteners that is disposed at the other end thereof, on the ambient-facing surface thereof, and which selectively engages with the first portion of hook and loop fasteners, and when one end of the strap is attached to the wall, behind the group consisting of curtains, draperies, decorations, towels and vertical blinds, and the strap is wrapped around the group consisting of curtains, draperies, decorations, towels and vertical blinds, and the first portion of hook and loop fasteners is engaged with the second portion of hook and loop fasteners, behind the group consisting of curtains, draperies, decorations, towels and vertical blinds, the group consisting of curtains, draperies, decorations, towels and vertical blinds is tied back against the wall.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Figure 3:
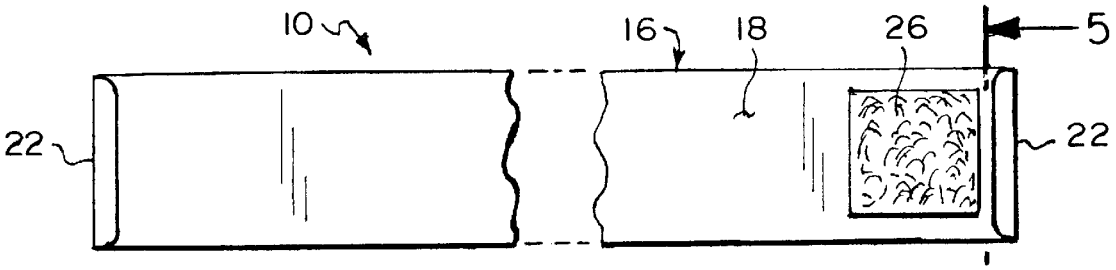
FIG. 3 is a diagrammatic front elevational view of the present invention shown in FIGS. 1 and 2.

10 customizable device of present invention for tying back group consisting of curtains, draperies, decorations, towels and vertical blinds 12 to wall 14
12 group consisting of curtains, draperies, decorations, towels and vertical blinds
14 wall
16 strap
18 curtain-facing surface of strap 16
20 ambient-facing surface of strap 16
22 pair of ends of strap 16
24 material for customizing strap 16
26 first portion of hook and loop fasteners on strap 16
28 second portion of hook and loop fasteners on strap 16

DESCRIPTION OF THE PREFERRED EMBODIMENT

Figure 1:
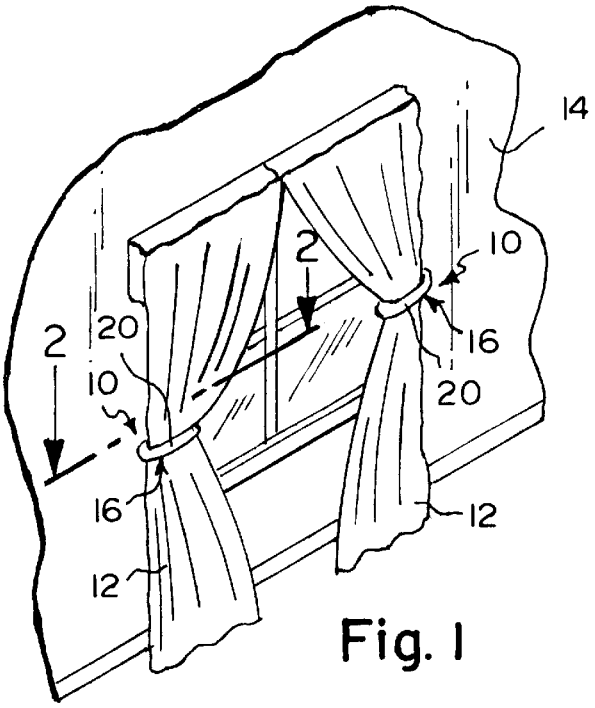
FIG. 1 is a diagrammatic perspective view of the present invention in use.
Figure 2:
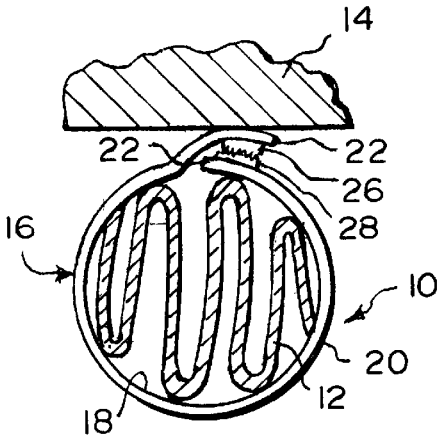
FIG. 2 is an enlarged diagrammatic cross sectional view taken on line 2—2 in FIG. 1.

Referring now to the figures, in which like numerals indicate like parts, and particularly to FIGS. 1 and 2, the customizable device of the present invention is shown generally at 10 for tying back a group consisting of curtains, draperies, decorations, towels and vertical blinds 12 to a wall 14.

Figure 4:
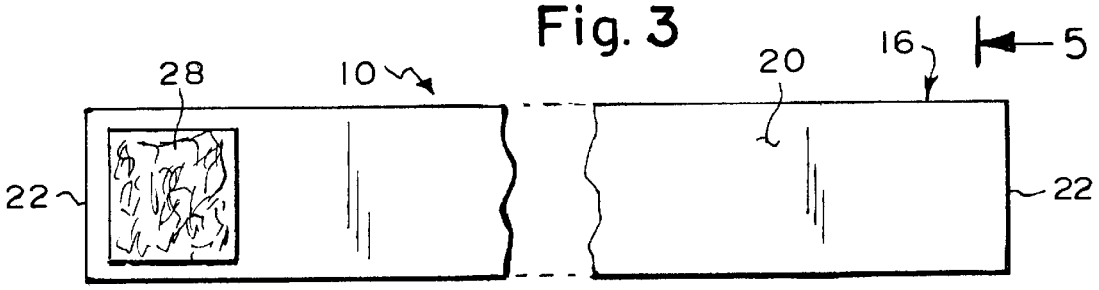
FIG. 4 is a diagrammatic rear elevational view of the present invention shown in FIGS. 1 and 2.
Figure 5:
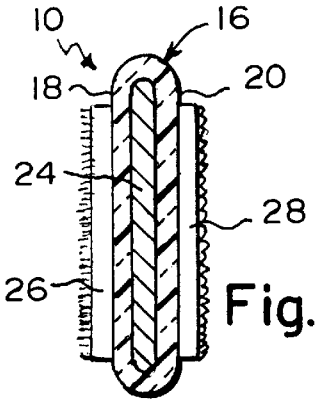
FIG. 5 is an enlarged diagrammatic cross sectional view taken on line 5—5 in FIG. 3.

The configuration of the customizable device 10 can best be seen in FIGS. 3–5, and as such, will be discussed with reference thereto.

The customizable device 10 comprises a strap 16 that is thin, slender, elongated, and has a curtain-facing surface 18, an ambient-facing surface 20 that is opposite to the curtain-facing surface 18 thereof, and a pair of ends 22, one of which for attaching to the wall 14.

The strap 16 is tubular and opens at the pair of ends 22 thereof for insertion of a material 24 therein for customizing the strap 16.

The pair of ends 22 of the strap 12 are relieved on the curtain-facing surface 18 thereof for facilitating insertion of the material 24 therein.

The strap 16 is clear for allowing the material 24 therein to be visible therethrough.

The strap 16 is made of flexible plastic for encircling the group consisting of curtains, draperies, decorations, towels and vertical blinds 12.

The strap 16 further has a first portion of hook and loop fasteners 26 that is disposed at one end 22 thereof, on the curtain-facing surface 18 thereof.

The strap 16 further has a second portion of hook and loop fasteners 28 that is disposed at the other end 22 thereof, on the ambient-facing surface 20 thereof, and which selectively engages with the first portion of hook and loop fasteners 26.

The method of using the customizable device for tying back the group consisting of curtains, draperies, decorations, towels and vertical blinds 12 to the wall 14 can best be seen in FIG. 2, and as such, will be discussed with reference thereto.

STEP 1:

The one end 22 of the strap 16 is attached to the wall 14, behind the group consisting of curtains, draperies, decorations, towels and vertical blinds 12.

STEP 2:

The strap 16 is wrapped around the group consisting of curtains, draperies, decorations, towels and vertical blinds 12.

STEP 3:

The first portion of hook and loop fasteners 26 on the strap 16 is engaged with the second portion of hook and loop fasteners 28 on the strap 16, behind the group consisting of curtains, draperies, decorations, towels and vertical blinds 12, and the group consisting of curtains, draperies, decorations, towels and vertical blinds 12 is tied back against the wall 14.

It will be understood that each of the elements described above, or two or more together, may also find a useful application in other types of constructions differing from the types described above.

While the invention has been illustrated and described as embodied in a customizable device for tying back a curtain to a wall, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A customizable device for tying back a group consisting of curtains, draperies, decorations, towels and vertical blinds to a wall, comprising a strap being thin, slender, elongated, and having:

a) a curtain-facing surface;

b) an ambient-facing surface opposite to said curtain-facing surface thereof;

c) a pair of ends, one of which for attaching to the wall; said strap being tubular and openina at said pair of ends thereof for insertion of a material therein for customizing said strap; said pair of ends of said strap being relieved on said curtain-facing surface thereof for facilitating insertion of the material; said strap being clear for allowing the material therein to be visible therethrough;

d) a first portion of hook and loop fasteners disposed at one end thereof, on said curtain-facina surface thereof; and e) a second portion of hook and loop fasteners disposed at the other end thereof, on said ambient-facing surface thereof, and selectively engaging with said first portion of hook and loop fasteners thereon, and when said one end of said strap is attached to the wall, behind the group consisting of curtains, draperies, decorations, towels and vertical blinds, and said strap is wrapped around the group consisting of curtains, draperies, decorations, towels and vertical blinds, and said first portion of hook and loop fasteners on said strap is engaged with said second portion of hook and loop fasteners on said strap, behind the group consisting of curtains, draperies, decorations, towels and vertical blinds, the group consisting of curtains, draperies, decorations, towels and vertical blinds is tied back against the wall.

2. The device as defined in claim 1, wherein said strap is made of flexible plastic for encircling the group consisting of curtains, draperies, decorations, towels and vertical blinds.

* * * * *